United States Patent [19]

Ostrowsky

[11] 4,427,126

[45] Jan. 24, 1984

[54] VENTED CLOSURE

[75] Inventor: Efrem M. Ostrowsky, Highland Park, Ill.

[73] Assignee: Ethyl Products Company, Richmond, Va.

[21] Appl. No.: 271,776

[22] Filed: Jun. 8, 1981

[51] Int. Cl.[3] ..... B65D 51/16

[52] U.S. Cl. ..... 215/307; 220/366

[58] Field of Search ..... 215/307, 329; 220/360, 220/366

[56] References Cited

U.S. PATENT DOCUMENTS

| | | | |
|---|---|---|---|
| 1,739,659 | 12/1929 | Spahn | 215/307 |
| 3,888,347 | 6/1975 | Kramer | 215/307 X |
| 4,007,848 | 2/1976 | Snyder | 215/307 X |
| 4,007,851 | 2/1977 | Walker | 215/307 |
| 4,206,852 | 6/1980 | Dunn et al. | 215/307 X |

*Primary Examiner*—Donald F. Norton

*Attorney, Agent, or Firm*—Donald L. Johnson; John F. Sieberth; Edgar E. Spielman, Jr.

[57] ABSTRACT

A thermoplastic closure suitable for fitment to a threaded container neck is disclosed. The closure has at least one venting groove in the sidewall traversing the closure thread. A rigidifying means is provided at the point of traverse of the venting groove and the closure thread. This rigidifying means has a perpendicular height measured from the sidewall less than the perpendicular height of the closure thread also measured from the sidewall. The rigidifying means provides hoop strength to the closure sidewall.

4 Claims, 4 Drawing Figures

VENTED CLOSURE

BACKGROUND OF THE INVENTION

The utilization of threaded closures for use in packaging of carbonated beverages has become very popular. The popularity is due in part to the fact that the consumer can open the package by merely unscrewing the closure from the container. No "bottle opening" tool is needed. Another advantage is that the consumer is able to remove the closure, dispense part of the contents from the container and reclose the container by merely screwing the closure back thereon. Since the sealing system is generally of high fidelity, there will be little loss of carbonation and the remaining packaged product will be suitable for use at a later time.

Despite these advantages, the threaded container-closure package has potentially a serious problem, i.e., premature release of the closure from the container which can occur with great force. The premature release occurs as the user turns the closure to remove it from the container. As the closure is turned, it moves axially upwardly thus breaking the seal between the top of the closure and the top of the container. Upon loss of the seal, pressurized gas enters between the sidewall of the closure and the container tending to bulge the closure sidewall outwardly. As the sidewall of the closure bulges outwardly, the closure threads are pulled away from engagement with the container threads thereby making the connection between the container and closure tenuous at best. If the gas is under sufficient pressure, the closure will be released from the container since the container-closure thread engagement is insufficient to contain the pressurized gas. This release is oftentimes with great force, thereby presenting danger to the consumer.

One of the most popular threaded closures used in packaging carbonated products is the nearly ubiquitous metal cap. To aid in preventing premature release of this type of closure the art has suggested providing a vent slot through the container threads. The slot provides a path for the pressurized gas to vent to the atmosphere, thus preventing closure bulge. See U.S. Pat. No. 4,007,848. In U.s. Pat. No. 4,007,851, another venting method for metal closures is shown. The closure is constructed to have, at a point adjacent the intersection of the sidewall and the top wall, at least one vent through which the pressurized gas may pass. Another type of system, one which uses circumferential venting, is shown in U.S. Pat. No. 1,739,659. These systems, while they may work in theory, are not particularly desirable as either they require modification in the design of the container threaded neck portion, they have dirt trapping openings in the closure itself, or they do not provide a sufficient amount of venting.

These problems can be solved by the utilization of thermoplastic closures. Thermoplastic closures can be designed so that a vent groove is cut on the inside surface of the closure sidewall across the closure threads. See U.S. Pat. No. 3,888,347. The width of the vent groove and the number of vent grooves utilized can be varied to provide the necessary venting rate for the conditions expected. Further, with this type of system, there will be no dirt entrapping openings exposed to the outside of the closure. (The use of such a groove on a metal closure is not practical as the metal closures used in packaging carbonated beverages are almost all roll formed on the container from a blank.)

Desirable as it may be, the location of the vent slot in the closure presents problems itself. The use of the vent slot requires a recessed cut in the closure sidewall across the closure thread, with the result being that the closure sidewall is thinner at the vent slot and unsupported by a continuous thread. Upon tightening the closure to the container, the weakened sidewall will expand outwardly as, in its weakened configuration, it cannot support the forces applied on it by the engagement of the container and closure threads. Also, when the closure is loosened from its seal position, the pressurized gas can cause the weakened closure sidewall to expand. Both, the closure expansion realized upon tightening and the closure expansion caused by the pressurized gas, jeopardize the closure-container thread engagement. When the thread engagement is compromised to the extent that the pressure inside the closure cannot be held by the threads, then premature release of the closure occurs. Using a closure with thickened sidewalls is not an answer as such a closure uses more thermoplastic material per closure and could not compete economically in the marketplace.

Therefore, it is an object of this invention to provide a thermoplastic closure having a thin structurally sound sidewall while at the same time having a vent groove in the inside surface of the closure sidewall and extending across the closure threads.

THE INVENTION

This invention relates to an improved thermoplastic closure which is suitable for fitment to the container having a threaded neck. This container-closure package is highly suitable for use in packaging products, i.e., carbonated beverages, which develop internal package pressure. The thermoplastic closure has a top wall with an annular sidewall downwardly depending therefrom. About the inside surface of the annular sidewall there is provided a closure thread for cooperation with the container neck thread. A sealing system is also provided above the closure thread for effecting a gas-tight seal between the closure and the container. This sealing system can be either a linerless system or a system which utilizes a liner. Such systems are well known to those skilled in the art and the only requirement for use of a sealing system with the closure of this invention is that it be capable of holding expected internal package pressures. To provide relief of internal package pressures as the closure of this invention is unscrewed from the container, the closure features at least one venting groove in the closure sidewall which traverses the closure thread. Rigidifying structure is also provided to enhance the hoop strength of the closure sidewall at the venting groove(s). The structure is located at each point of traverse by the venting groove with the closure thread. This structure is dimensioned so that its perpendicular height, measured from the sidewall, is less than the perpendicular height of the closure thread also measured from the inside surface of the sidewall. By having the rigidifying structure with this smaller dimension, the pressurized gas is able to find sufficient escapement cross sectional area in the venting groove. Location of the rigidifying structure at the point(s) of intersection of the vent groove and the closure thread insures that no threading interference will occur between the structure and the cooperation of the closure and container threads.

These and other features of this invention contributing to satisfaction in use and economy in manufacture will be more fully understood when taken in connection with the following description of preferred embodiments and the accompanying drawings in which identical numerals refer to identical parts and in which.

Figure 1:
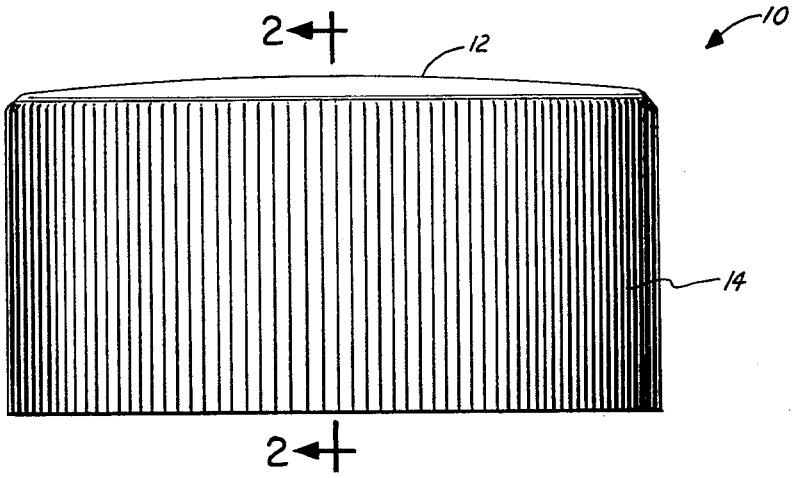
FIG. 1 is a side elevational view of a closure of this invention.

Referring now to FIGS. 1–4, it can be seen that a closure of this invention, generally designated by the numeral 10, has a top wall 12 and an annular downwardly depending sidewall 14. About the inside surface of sidewall 14 is provided a helical closure thread 16. Closure thread 16 is dimensioned for cooperation with container thread 42, shown in FIG. 3, to achieve fitment of closure 10 to container neck 40.

Figure 2:
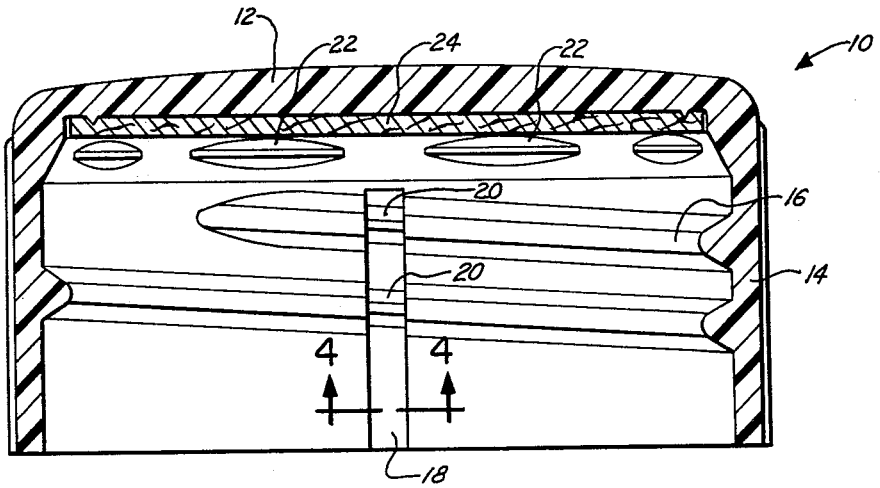
FIG. 2 is a sectional view taken through section line 2—2 in FIG. 1.
Figure 4:
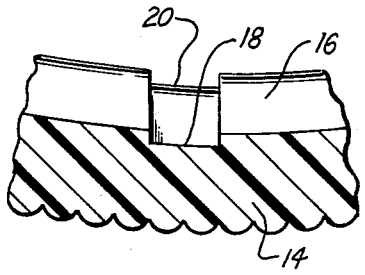
FIG. 4 is a sectional view taken through section line 4—4 of FIG. 2.

Extending from a point above closure thread 16 to a point below closure thread 16 is venting groove 18. As is shown in FIGS. 2 and 4, venting groove 18 is on the inside surface of sidewall 14. FIG. 4 shows that venting groove 18 has a depth such that it is recessed into the inside surface of sidewall 14. The width of venting groove 18, coupled with the number of venting grooves used, is such that sufficient venting groove cross sectional area is provided for venting of the pressurized gas at a rate so that conventional removal of closure 10 from the container will occur only after the venting is substantially accomplished.

Traversing venting groove 18 at each point of its intersection with closure thread 16 is rigidifying structure 20. For the embodiment shown in FIGS. 2 and 4, rigidifying structure 20 has a cross sectional shape resembling a truncated pyramid. Whatever the form of rigidifying structure 20, it cannot have a height, measured from the inside surface of sidewall 14, greater than the height of closure thread 16, also measured from the inside surface of sidewall 14. However, the height of rigidifying structure 20 should not be so small that it is not able to achieve its required enhancement of sidewall hoop strength. Determination of the height of rigidifying structure 20 will be dependent on several factors, i.e., the pressures expected to be encountered, the material of construction for the closure, the width and depth venting groove(s) 18, the length of closure thread 16 and the degree of engagement between closure thread 16 and container thread 20. An example of a useful closure is one made of polypropylene having a vent groove width of about 1/16" and depth of about 0.005/0.015, a sidewall thickness of 0.035/0.040", a closure thread traversing approximately 480 degrees having conventional thread engagement and a rigidifying structure height of about $\frac{2}{3}$ of thread height. For other materials and other venting channel depths and sidewall thicknesses, the sizing of rigidifying structure 20 is empirically determined by observation and experimentation, both of which are well within the ability of those skilled in the art having the disclosure of this invention before them.

Figure 3:
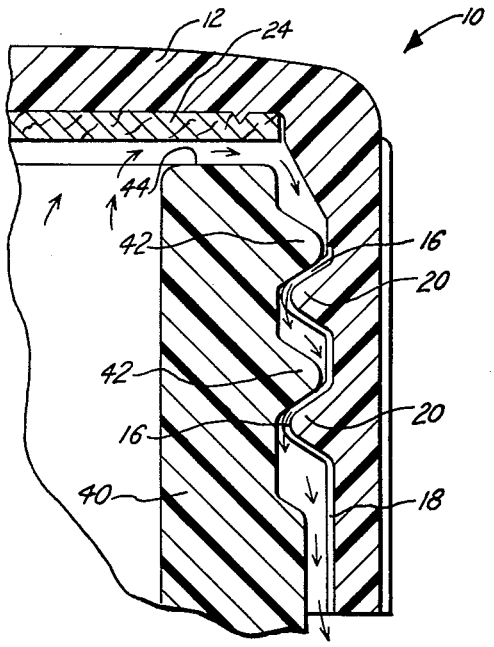
FIG. 3 is an enlarged sectional view showing the path of escapement for the pressurized gas as the closure shown in FIGS. 1 and 2 is removed from a container.

For the embodiment shown in FIGS. 2 and 3, the sealing system uses a liner. The liner 24 nests against the inside surface of top wall 12. Retaining beads 22 are utilized to maintain liner 24 in adjacent position to the inside surface of top wall 12 when closure 10 is not fitted to the container. As before mentioned, the sealing system can be either with a liner or without a liner and can be of any configuration so long as it is capable of maintaining a gas-tight seal under the conditions and internal pressures anticipated by the packager.

In FIG. 3, the venting of pressurized gas from the package is shown. Note that as closure 10 is rotated about container neck 40, closure 10 moves axially upward. This axial upward movement results in liner 24 being removed from its nesting position on the top 44 of container neck 40. Pressurized gas in the interior of the container begins movement through groove 18 as indicated by the arrows. As can be seen, the utilization of rigidifying structure 20 does not interfere with passage of the pressurized gas while at the same time the aforementioned enhancement in hoop strength provided by rigidifying structure 20 is realized. As closure 10 continues its removal rotation, pressurized gas is continuously vented until the interior package pressure is equal to ambient pressure. Since there has been no loss of container thread to closure thread cooperation, removal of closure 10 is done without fear of premature closure release.

The closures of the invention can be made by any conventional injection molding technique. The thermoplastic materials which may be utilized for producing this closure are those which are conventionally utilized in closure manufacture. For example, the closure may be made from polyethylene terepthalate, high density polyethylene, polypropylene, nylon, polyvinyl chloride, etc.

What is claimed:

1. In a thermoplastic closure suitable for fitment to a threaded container neck wherein the closure includes:

(a) a top wall, (b) an annular sidewall downwardly depending from the top wall, (c) a closure thread carried on the inside surface of the annular sidewall for cooperation with the container neck thread, (d) a sealing system above the closure thread for effecting a gas-tight seal between the closure and the container, and (e) at least one venting groove in the sidewall traversing the closure thread, the improvement which comprises a rigidifying means at each point of traverse by said venting groove of said closure thread, said rigidifying means being dimensioned so that it has a perpendicular height measured from the inside surface of said sidewall less than the perpendicular height of said closure thread measured from the inside surface of said sidewall, whereby pressurized gas can pass through said venting groove to the atmosphere as said closure is removed from said container.

2. The closure of claim 1 wherein said rigidifying means when viewed in cross section has the shape of a truncated pyramid.

3. The closure of claim 2 wherein said closure is made of polypropylene.

4. The closure of claim 1 wherein said closure is made of polypropylene.

* * * * *

REEXAMINATION CERTIFICATE (291st)

United States Patent [19]

Ostrowsky

[11] B1 4,427,126

[45] Certificate Issued Dec. 25, 1984

[54] VENTED CLOSURE

[75] Inventor: Efrem M. Ostrowsky, Highland Park, Ill.

[73] Assignee: Ethyl Products Company, Richmond, Va.

Reexamination Request:
No. 90/000,560, May 21, 1984

Reexamination Certificate for:

| | |
|---|---|
| Patent No.: | **4,427,126** |
| Issued: | **Jan. 24, 1984** |
| Appl. No.: | **271,776** |
| Filed: | **Jun. 8, 1981** |

[51] Int. Cl.[3] ..... B65D 51/16
[52] U.S. Cl. ..... 215/307; 220/366
[58] Field of Search ..... 215/307, 329, 260; 220/360, 366

[56] References Cited

U.S. PATENT DOCUMENTS

| | | | |
|---|---|---|---|
| 2,990,079 | 6/1961 | Garvey | 215/260 |
| 4,206,852 | 6/1980 | Dunn et al. | 215/307 X |

OTHER PUBLICATIONS

European Patent Application Publication No. 0 009 854, published Apr. 16, 1980.

*Primary Examiner*—Donald F. Norton
*Attorney, Agent, or Firm*—Donald L. Johnson; John F. Sieberth; E. Donald Mays

[57] ABSTRACT

A thermoplastic closure suitable for fitment to a threaded container neck is disclosed. The closure has at least one venting groove in the sidewall traversing the closure thread. A rigidifying means is provided at the point of traverse of the venting groove and the closure thread. This rigidifying means has a perpendicular height measured from the sidewall less than the perpendicular height of the closure thread also measured from the sidewall. The rigidifying means provides hoop strength to the closure sidewall.

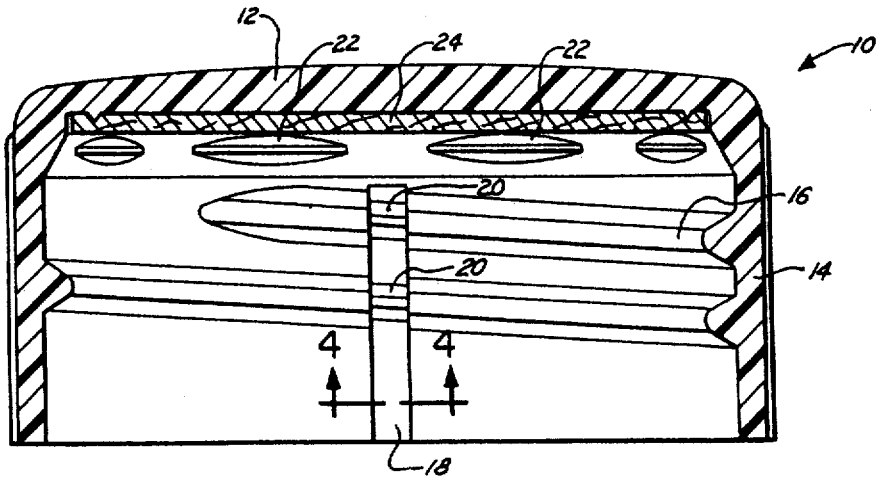

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 1 is determined to be patentable as amended.

Claims 2–4, dependent on an amended claim, are determined to be patentable.

New claims 5–7 are added and determined to be patentable.

1. In a thermoplastic closure suitable for fitment to a threaded container neck wherein the closure includes:

(a) a top wall, (b) an annular sidewall downwardly depending from the top wall, (c) a closure thread carried on the inside surface of the annular sidewall for cooperation with the container neck thread, (d) a sealing system above the closure thread for effecting a gas-tight seal between the closure and the container, and (e) at least one venting groove in the sidewall traversing the closure thread, the improvement which comprises a rigidifying means at each point of traverse by said venting groove of said closure thread, said rigidifying means being dimensioned so that it has a perpendicular height measured from the inside surface of said sidewall less than the perpendicular height of said closure thread measured from the inside surface of said sidewall [,] *but having a perpendicular height sufficient to enhance the hoop strength of said annular sidewall,* whereby pressurized gas can pass through said venting groove to the atmosphere as said closure is removed from said container.

*5. The closure of claim 1 wherein said rigidifying means is a structure having a height of about ⅔ of the height of said closure thread, both heights being measured from the inside surface of said sidewall.*

*6. The closure of claim 1 wherein the number of said venting grooves in said sidewall and the depth of said grooves in said sidewall is such that sufficient venting groove cross section area is provided for venting the pressurized gas at a rate so that conventional removal of said closure from said threaded neck will occur only after the venting is substantially accomplished.*

*7. The closure of claim 5 wherein said venting groove has a width of about 1/16 inch, a depth of from about 0.005 inch to about 0.015 inch, and said sidewall has a thickness of from about 0.035 inch to about 0.040 inch.*

* * * * *